US008061261B2

(12) United States Patent
Jacobsen et al.

(10) Patent No.: US 8,061,261 B2
(45) Date of Patent: Nov. 22, 2011

(54) ANTAGONISTIC FLUID CONTROL SYSTEM FOR ACTIVE AND PASSIVE ACTUATOR OPERATION

(75) Inventors: Stephen C. Jacobsen, Salt Lake City, UT (US); Marc Olivier, Sandy, UT (US)

(73) Assignee: Raytheon Company, Waltham, MA (US)

( * ) Notice: Subject to any disclaimer, the term of this patent is extended or adjusted under 35 U.S.C. 154(b) by 449 days.

(21) Appl. No.: 12/074,260

(22) Filed: Feb. 28, 2008

(65) Prior Publication Data

US 2008/0216644 A1 Sep. 11, 2008

Related U.S. Application Data

(60) Provisional application No. 60/904,245, filed on Feb. 28, 2007.

(51) Int. Cl.
*F15B 13/042* (2006.01)
*F15B 11/10* (2006.01)

(52) U.S. Cl. ..... 91/457; 91/433

(58) Field of Classification Search ..... 91/433, 91/454, 457

See application file for complete search history.

(56) References Cited

U.S. PATENT DOCUMENTS

| | | | |
|---|---|---|---|
| 204,828 | A | 6/1878 | Jenkins |
| 2,861,550 | A | 11/1958 | Hanna et al. |
| 3,566,919 | A | 3/1971 | Vanderlaan |
| 3,583,422 | A | 6/1971 | Dach |
| 3,593,522 | A | 7/1971 | Angert |
| 3,628,554 | A | 12/1971 | Wilson |
| 3,732,887 | A | 5/1973 | Hayner |
| 3,882,551 | A | 5/1975 | Helmer et al. |
| 3,894,712 | A | 7/1975 | Millar et al. |
| 3,927,602 | A | 12/1975 | Strauff |

(Continued)

FOREIGN PATENT DOCUMENTS

| | | |
|---|---|---|
| DE | 10 53 462 | 3/1959 |

(Continued)

OTHER PUBLICATIONS

Stephen C. Jacobsen, U.S. Appl. No. 12/074,261, filed Feb. 28, 2008.

(Continued)

*Primary Examiner* — Michael Leslie
(74) *Attorney, Agent, or Firm* — Thorpe North & Western LLP

(57) ABSTRACT

An antagonistic fluid control system, wherein the system may comprise multiple antagonistic pressure control valves operable with a single actuator, or multiple pressure control valves operable with respective antagonistic actuators. The pressure control valves are configured to provide functional and efficiency advantages, and operate together to provide several operating or valving states. A first valving state comprises an active valving state configured to actively control the movement of the load. A second valving state comprises an inactive actuation state, wherein either the return and pressure ports of one pressure control valve are closed, or only the return ports of one pressure control valve are opened, to allow the other pressure control valve to operate in an active valving state. A third valving state comprises a passive valving state, wherein the pressure control valves are operated in a slosh mode configured to allow the load to freely move or dangle. In this third passive valving state, or slosh mode, the return ports of the two pressure control valves are opened to allow fluid, and preferably local fluid, to shunt back and forth within the system.

18 Claims, 5 Drawing Sheets

U.S. PATENT DOCUMENTS

| | | | | |
|---|---|---|---|---|
| 3,986,353 | A | 10/1976 | Otsubo et al. | |
| 4,067,357 | A | 1/1978 | Ruchser | |
| 4,069,843 | A | 1/1978 | Chatterjea | |
| 4,131,130 | A | 12/1978 | Ruby | |
| 4,142,612 | A | 3/1979 | Riddel | |
| 4,150,543 | A | 4/1979 | Helmer et al. | |
| 4,203,465 | A | 5/1980 | Rissi | |
| 4,211,147 | A | 7/1980 | Panissidi et al. | |
| 4,266,466 | A | 5/1981 | Zienms | |
| 4,273,030 | A | 6/1981 | Beeskow et al. | |
| 4,286,432 | A | 9/1981 | Burrows et al. | |
| 4,348,159 | A | 9/1982 | Acheson | |
| 4,362,018 | A | 12/1982 | Torii | |
| 4,422,293 | A | 12/1983 | Ewald | |
| 4,478,250 | A | 10/1984 | Lukasczyk et al. | |
| 4,531,369 | A | 7/1985 | Izumi et al. | |
| 4,602,481 | A | 7/1986 | Robinson | |
| 4,611,621 | A | 9/1986 | Miyakawa et al. | |
| 4,657,042 | A | 4/1987 | Lewis | |
| 4,667,571 | A | 5/1987 | Walters | |
| 4,674,539 | A | 6/1987 | Sloate | |
| 4,714,459 | A | 12/1987 | Hooven | |
| 4,774,976 | A | 10/1988 | Janecke et al. | |
| 4,782,859 | A | 11/1988 | Constantinian | |
| 4,819,690 | A | 4/1989 | Takahashi | |
| 4,923,170 | A | 5/1990 | Takaoka et al. | |
| 4,941,508 | A | 7/1990 | Hennessy et al. | |
| 5,011,180 | A | 4/1991 | Dunwoody | |
| 5,036,750 | A | 8/1991 | Katayama | |
| 5,058,626 | A | 10/1991 | Takaoka et al. | |
| 5,103,866 | A | 4/1992 | Foster | |
| 5,123,450 | A | 6/1992 | Wood et al. | |
| 5,282,460 | A | 2/1994 | Boldt | |
| 5,317,953 | A | 6/1994 | Wentworth | |
| 5,363,724 | A | 11/1994 | Asahara et al. | |
| 5,385,171 | A | 1/1995 | Cleasby | |
| 5,499,320 | A | 3/1996 | Backes et al. | |
| 5,522,301 | A | 6/1996 | Roth et al. | |
| 5,538,480 | A | 7/1996 | Torimoto | |
| 5,644,967 | A | 7/1997 | Joerg et al. | |
| 5,832,882 | A | 11/1998 | Matsuda | |
| 5,872,893 | A | 2/1999 | Takenaka et al. | |
| 5,924,958 | A | 7/1999 | Tsuchiya et al. | |
| 5,941,795 | A | 8/1999 | Tsuchiya et al. | |
| 6,021,864 | A | 2/2000 | Sakata et al. | |
| 6,223,648 | B1 | 5/2001 | Erickson | |
| 6,269,733 | B1 | 8/2001 | Reust | |
| 6,463,959 | B2 | 10/2002 | Kremer | |
| 6,467,264 | B1 * | 10/2002 | Stephenson et al. | 91/454 |
| 6,580,969 | B1 | 6/2003 | Ishida et al. | |
| 6,601,602 | B2 | 8/2003 | Adler et al. | |
| 6,915,230 | B2 | 7/2005 | Kawai et al. | |
| 6,962,220 | B2 | 11/2005 | Takenaka et al. | |
| 6,966,882 | B2 | 11/2005 | Horst | |
| 6,992,456 | B2 | 1/2006 | Furuta et al. | |
| 7,153,242 | B2 | 12/2006 | Goffer | |
| 7,190,141 | B1 | 3/2007 | Ashrafiuon et al. | |
| 7,217,247 | B2 | 5/2007 | Dariush et al. | |
| 7,284,471 | B2 | 10/2007 | Jacobsen et al. | |
| 7,308,848 | B2 * | 12/2007 | Jacobsen et al. | 91/433 |
| 7,313,463 | B2 | 12/2007 | Herr et al. | |
| 7,324,872 | B2 | 1/2008 | Nagasaka | |
| 2002/0026869 | A1 | 3/2002 | Morita et al. | |
| 2006/0137519 | A1 | 6/2006 | Jacobsen et al. | |
| 2006/0144218 | A1 | 7/2006 | Jacobsen et al. | |
| 2006/0249315 | A1 | 11/2006 | Herr et al. | |
| 2008/0028924 | A1 | 2/2008 | Stephenson | |

FOREIGN PATENT DOCUMENTS

| | | |
|---|---|---|
| FR | 1 104 952 | 11/1955 |
| FR | 1 524 697 | 5/1968 |
| GB | 997 756 | 7/1965 |
| GB | 1 245 662 | 9/1971 |
| WO | WO 2007/017197 | 2/2007 |
| WO | WO 2008/106618 | 9/2008 |

OTHER PUBLICATIONS

Kawamura S et al., "A new type of pneumatic robot using bellows actuators with force sensing ability" Robotics and Automation, 1994. Proceedings, 1994 IEEE International Conference in San Diego, California, USA May 8-13, 1994, Los Alamitos, CA USA IEEE Comput Soc May 8, 1994 pp. 2451-2456, XP010097488.

Advertisement O + P Olhydraulik und pheumatik, vereinigte fachverlage, Mainz, DE vol. 38, No. 7, Jan. 1, 1994, pp. 388-391, XP000195286.

Schindling, Eva, "Towards Biomimetic Locomotion in Robotics," Goteborg, Sweden, 2006, pp. 1-18.

Carrozza, Maria Chiara, Biomechatronic Design of an exoskeleton for the upper limb, Neurobotics—the fusion of neuroscience and robotics, FP6-IST-001917, www.neurobotics.Info, Sep. 23, 2005, Benicassim, Spain, pp. 15.

U.S. Appl. No. 12/074,261, filed Feb. 28, 2008; Stephen C. Jacobsen; office action issued Jan. 31, 2011.

* cited by examiner

ANTAGONISTIC FLUID CONTROL SYSTEM FOR ACTIVE AND PASSIVE ACTUATOR OPERATION

RELATED APPLICATIONS

The present application claims the benefit of U.S. Provisional Patent Application No. 60/904,245, filed Feb. 28, 2007 the United States Patent and Trademark Office, which applications is incorporated by reference in its entirety herein.

FIELD OF THE INVENTION

The present invention relates generally to servo and servo-type systems and the valves contained therein. More particularly, the present invention relates to an antagonistic fluid control system, wherein multiple antagonistic actuators are controlled by respective pressure control valves.

BACKGROUND OF THE INVENTION AND RELATED ART

Control and servo systems, such as hydraulic or pneumatic systems, are well known and operate on the simple principle of transferring force from an applied location to an output location by means of a fluid. In hydraulic systems, the transfer is typically accomplished by means of an actuator cylinder having a piston contained therein pushing a substantially incompressible fluid through a fluid line to another cylinder, also having a piston, at a different location. One tremendous advantage to transferring force through a hydraulic system is that the fluid line connecting the two cylinders can be any length and shape, and can wind or bend through all sorts of positions separating the two pistons. The fluid line can also split into multiple other fluid lines thus allowing a master piston to drive multiple slave pistons. Another advantage of hydraulic systems is that it is very easy to increase or decrease the applied force at the output location. This hydraulic force multiplication is accomplished by changing the size of one piston relative to the other.

In most hydraulic systems, cylinders and pistons are connected through valves to a pump supplying high-pressure hydraulic fluid functioning as the substantially incompressible fluid. Spool valves are the most commonly used valves in hydraulic systems and can apply pressure to either the front or back faces of the piston inside the hydraulic actuators. When one side the actuator cylinder is pressurized, the spool valve simultaneously opens a return line to the opposite side of the actuator, allowing the substantially incompressible hydraulic fluid on the opposing side of the piston to bleed back into a return reservoir. This relieves any internal pressure that would oppose the movement of the actuator, and limits the work required by the actuator to only that which is needed to drive the external load. As a result, spool valves are ideally suited to hydraulic systems because they allow efficient control of the flow rate to achieve hydraulic force.

Still, in spite of the advantages of spool valves in hydraulic systems, existing spool valves have certain design limitations. Traditional spool valves have been designed to be actuated by either mechanical levers, electrical servos or internal control pressures called pilot pressures, which are provided by way of a pilot valve. Spool valves are commonly mounted in a cylindrical sleeve or valve housing with fluid ports extending through the housing, which can be opened or closed for fluid communication with each other by positioning the lands and recesses of the spool in appropriate locations within the sleeve. The working pressure is varied by displacing the valve spool to open or close the valve allowing varying amounts of pressurized fluid to flow from the supply reservoir.

In the case of electrical actuation, the valve is controlled by an electrical input current from an electrical source. The current may be related to the pressure in the system in that the greater the current supplied, the wider the pressure or supply port is opened allowing pressurized fluid to flow into and through the valve with less restriction. When the load pressure in the actuator finally equals the supply pressure then flow stops. In other words, a given current controls the size of the openings in the pressure or return ports, which in turn controls the flow rate of fluid into or away from the hydraulic actuator. In order for the system to operate correctly, there must a be constant pressure differential across the spool valve. Otherwise, as the load pressure approaches the supply reservoir pressure the valve loses linear response and its operation becomes unstable. Consequently, spool valves are typically operated in systems where the pressure of the source (i.e. the supply reservoir) is very high compared to the range of opposing load pressures, and the flow versus input current at a given pressure is linear in the usable region.

What this means is that the system, and particularly the load, is always in a pressurized state and cannot be freely moved by an external force or under its own weight. As such, the load cannot easily be moved without actual active actuation. In other words, the actuator cannot be passively back driven. Such a configuration is extremely inefficient, as active input in the form of pressurized fluid is required to displace or actuate a load, even in the presence of gravity or in response to momentum (e.g. while braking). The use of pressurized fluid creates a significant energy loss as new pressurized fluid must always be supplied in order to move and/or brake the load.

In addition to the current flow problems of traditional spool valves, classical hydraulic systems are problematic for several other reasons. First, complex controllers are needed to control the cycle times of valves and pistons. Second, cycle times for moving pistons are often long because large amounts of fluid are required to move output pistons. Third, the large quantity of fluid needed to drive output pistons requires constant pressurization of large reservoirs of fluid accumulators. Consequently, hydraulic machines typically require large amounts of hydraulic fluid for operation and therefore require large external reservoirs to hold the difference in the volume of fluid displaced by the two sides of any cylinder.

Classical spool valve devices are also limited in application because when a controlled flow is induced through a valve it generally translates directly into a controlled velocity of the actuator's piston. Consequently, complex system feedback devices must be used to convert the hydraulic energy from velocity inputs into a system based on load position. Introducing feed back control devices into the system limits its response to the bandwidth of the feedback loop and the responsiveness of the valves such that the time delays between the feedback devices and the valves make the system unstable when a resistive force is applied.

Still other problems exist with classical servo valves operating in classical servo systems. Due to the problems discussed above, these valves and systems are incapable of performing at high bandwidths without going unstable. In addition, significant amounts of energy may be lost due to leakage when not all of the valves in a multiple valve system are being used. Finally, the configuration of the spool can be limiting, with multiple lands and recesses formed in a single spool, and with the single spool functioning to open and close the pressure and return ports formed in the valve body.

SUMMARY OF THE INVENTION

In light of the problems and deficiencies inherent in the prior art, the present invention seeks to overcome these by providing an antagonistic fluid control system, wherein the system may comprise antagonistic pressure control valves (hereinafter known as "PCV" or "PCV's") operable with a single actuator, or multiple pressure control valves operable with respective antagonistic actuators. The pressure control valves are configured to provide functional and efficiency advantages.

In accordance with the invention as embodied and broadly described herein, the present invention resides in a fluid control system employing antagonistic pressure control, the fluid control system comprising: (a) a load actuator having an actuator piston coupled to a load, the load actuator configured to facilitate active and passive displacement of the load; (b) a first pressure control valve operable with the load actuator and configured to provide a control pressure to a first side of the piston of the load actuator and to facilitate active and passive displacement of the actuator piston and the load; and (c) a second pressure control valve operable with the load actuator and configured to provide a control pressure to a second side of the piston of the load actuator, and to facilitate active and passive displacement of the actuator piston and the load in a direction opposite that facilitated by the first pressure control valve, the second pressure control valve being antagonistic to the first pressure control valve, the first and second pressure control valves comprising an active valving state for selectively driving the actuator piston and the load in respective directions, and a passive valving state, wherein local fluid is caused to shunt back and forth within the fluid control system to allow the actuator piston and the load to passively displace in response to a non-actuated force acting on the load.

The present invention also features a fluid control system employing antagonistic pressure control, the fluid control system comprising: (a) a first load actuator having an actuator piston coupled to a load, the first load actuator configured to facilitate active and passive displacement of the load; (b) a second load actuator having an actuator piston also coupled to the load, the second load actuator configured to facilitate active and passive displacement of the load in an opposite direction; (c) a first pressure control valve operable with the first load actuator to provide a control pressure thereto to effectuate active and passive displacement of the actuator piston of the first load actuator and the load; (d) a second pressure control valve antagonistic to the first pressure control valve and operable with the second load actuator to provide a control pressure thereto and to effectuate active and passive displacement of the actuator piston of the second load actuator and the load, the first and second pressure control valves comprising an active valving state for selectively driving the actuator pistons of the first and second load actuators in opposite directions, respectively, and a passive valving state, wherein local fluid is caused to shunt back and forth within the fluid control system to allow the actuator pistons of the first and second load actuators to passively displace in response to a non-actuated force acting on the load.

The present invention further features a method for operating a fluid control system configured to drive a load, the method comprising: (a) providing a first pressure control valve configured with independent pressure and return spools; (b) providing a second pressure control valve also configured with independent pressure and return spools, said second pressure control valve also being configured to be operably antagonistic to the first pressure control valve; (c) coupling a first load actuator to the first pressure control valve, the first load actuator being configured to actuate a load; and (d) operating the first and second pressure control valves to actuate the load.

The method described above further comprises reducing the pilot pressure to be below the load pressure to cause the return spools of the first and second pressure control valves to displace to open the return inlet and outlet ports, and causing fluid to shunt back and forth between the first and second pressure control valves and at least one of the at least one load actuator via the return inlet and outlet ports of the first and second pressure control valves, thereby initiating a passive valving state, wherein the actuator pistons of the first and second load actuators are caused to passively displace in response to a non-actuated force acting on the load to enable the load to dangle. In addition, the method further comprises coupling a second load actuator to the second pressure control valve, the load actuator being configured to actuate the load in an opposite direction from that actuated by the first load actuator.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

Figure 1:
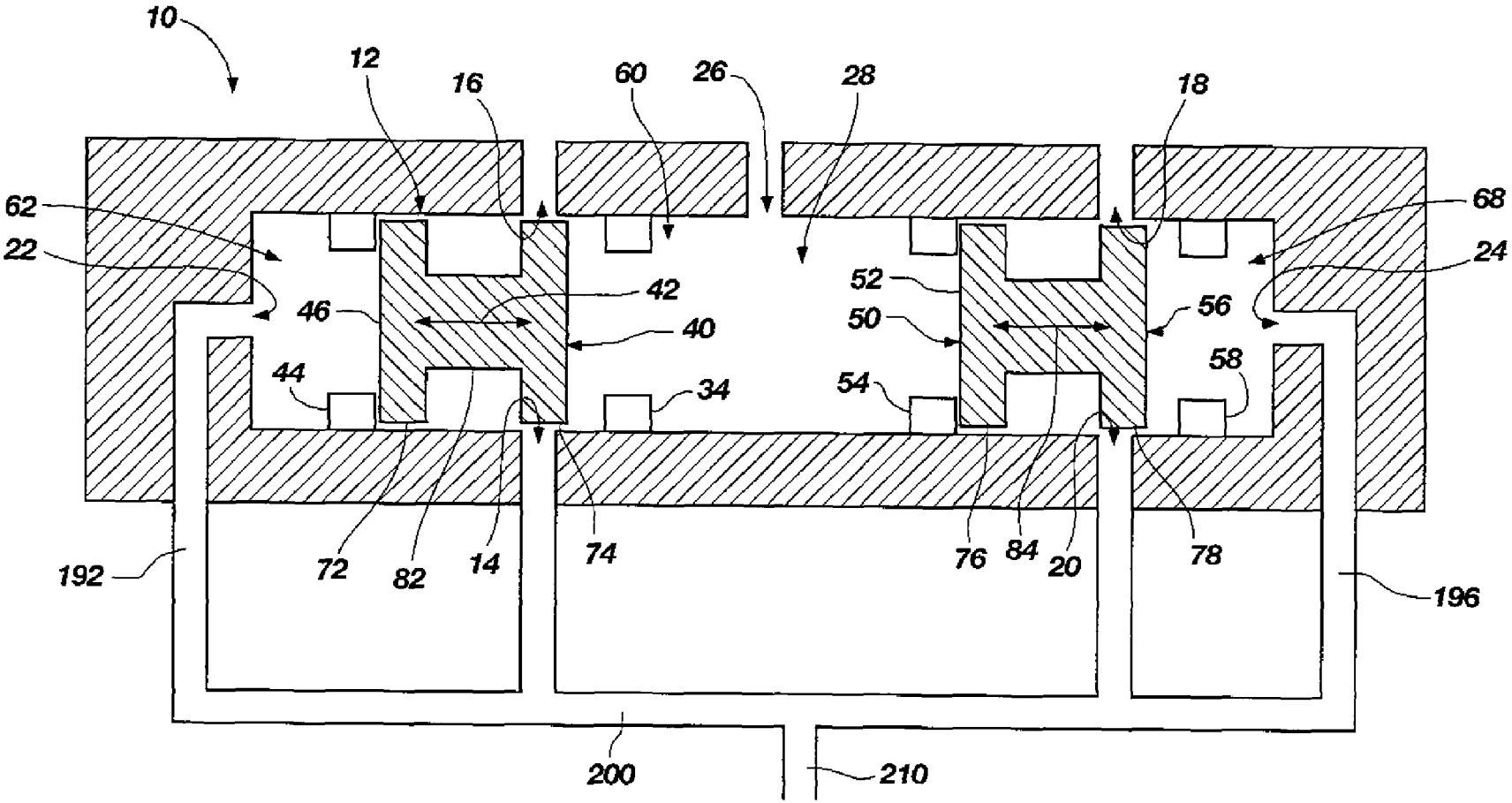
FIG. 1 illustrates a cut-away view, as taken along a longitudinal cross-section, of a dual independent spool pressure control valve according to one exemplary embodiment.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for providing a fluid control system by operably relating at least two pressure control valves (PCV or PCVs) with one another in an antagonistic relationship to provide control of a load, such as opposing tendons coupled to an actuator. The antagonistic PCVs are configured to provide significant functional and efficiency advantages over prior related valves.

Preliminarily, the terms "bilateral control" or "bilateral pressure regulation," as used herein, shall be understood to mean the ability of a single pressure control valve to effectuate two-way pressure regulation, meaning that the pressure control valve is able to regulate and control the pressures acting within the actuator on both sides of the actuator piston to displace the piston and therefore drive the load bi-directionally.

The term "pressure differential," as used herein, shall be understood to mean or shall refer to a state of non-equilibrium existing within the system between the pilot pressure and the load pressure. In some embodiments, a "pressure differential" may mean a simple difference in pressure magnitudes between the load pressure and the pilot pressure. In other embodiments, namely those utilizing area reduction for load/force translation or multiplication, a "pressure differential" may mean a non-proportional difference in pressure existing between the load pressure and the pilot pressure, taking into account the different areas of the valve body, the actuator, and any hydraulic multiplication.

The term "load pressure," as used herein, shall be understood to mean the pressure acting within the load actuator as induced or applied by a load, minus the friction or other losses internal to the actuator mechanism itself. The load pressure directly influences and dictates the feedback pressure.

The term "feedback pressure," as used herein, shall be understood to mean the pressure acting upon the feedback pressure sides of the independent return and pressure spools within the pressure control valves as received or dictated by the load pressure after all area reductions/increases and fluid pressure multiplications/divisions have occurred, if any. The feedback pressure may, in some cases, equal the load pressure.

The term "actuator" or "load actuator," as used herein, shall be understood to mean any system or device capable of converting fluid energy into usable energy, such as mechanical energy. A typical example of a load actuator is a hydraulic actuator coupled to a load, wherein the hydraulic actuator receives pressurized hydraulic fluid from a hydraulic fluid source and converts this into mechanical work or a force sufficient to drive the load.

The term "dangle," as used herein, shall be understood to mean the non-actuated free swing of the load in either direction in response to a non-actuated force acting on the load (e.g., one utilizing kinetic energy generated from an external force (an impact), momentum, etc.), wherein the movement of the load is achieved without providing active input from the fluid control system to move the load in either direction, which condition may be referred to as inactive passivity (as compared to the active passivity of prior related fluid control systems. The ability to dangle or free-swing is made possible by the various pressure control valves operating in a "slosh mode."

The term "slosh" or "slosh mode," as used herein, shall be understood to mean the inactive passive valving state of the antagonistic pressure control valves, wherein the pilot or control pressure in each valve is maintained below both the load and feedback pressure and the return reservoir pressure, thus causing the return spools in each valve to displace to and be maintained in the open position opening the return inlets and outlets, as well as causing the pressure spools to be maintained in the closed position closing off pressurized fluid. With the pilot pressure below both the load pressure and the feedback pressure and the return reservoir pressure, and with the pressure and return spools in these positions, local fluid is able to shunt or slosh back and forth between the load actuators and the valves through the open return ports of the pressure control valves in response to movement of the load, and thus the actuator. The shunting of local fluid is done with little or no resistance, thus improving the impedance of the system. In addition, as mentioned, only local fluid may be allowed to shunt back and forth, which means that the system only uses the fluid present in the actuators, the pressure control valves, and the various fluid lines connecting them rather than actively requiring pressurized fluid to enable actuation. Fluid in the pressure supply is neither used nor diluted, thus greatly improving the efficiency of the system.

In the slosh mode, no active input from pressurized fluid (e.g., power) is necessary to influence the dynamics of the actuators and the load in either direction as in prior related servo and fluid control systems. Indeed, prior related systems are only somewhat passive, meaning that some degree of active power or pressurized fluid is still needed to actuate the load in one or both directions, or rather to permit movement of the load in one or both directions. This prior art condition may be termed as "active passivity" because, although the system appears passive, it really is active, even if only slightly.

On the other hand, pressure control valve is capable of inactive passivity. "Inactive passivity" may be referred to as the ability of the pressure control valve, as contained within a servo or servo-type system, to allow the load to move or "dangle" in response to imposed external or internal conditions without any active input or influence from the system other than the operation of the pilot pressure or servo motor which controls the pilot pressure. More specifically, inactive passivity does not require any pressurized fluid from the supply reservoir to permit movement or actuation of the actuators or the load.

Dual Independent Spool Pressure Control Valves

With reference to FIG. 1, illustrated is a cut-away view, as taken along a longitudinal cross-section, of one exemplary embodiment of a valving system, namely a dual independent spool pressure control valve. Specifically, FIG. 1 illustrates a dual independent spool pressure control valve (PCV) 10 configured for regulating pressure within a closed-loop fluid control system, such as a hydraulic system. In the exemplary embodiment shown, the PCV 10 comprises a valve body 12 consisting of an in-line linear structure having formed therein a return inlet port 14, a return outlet port 16, a pressure inlet port 18, a pressure outlet port 20, first and second feedback ports in the form of a return spool feedback port 22 and a pressure spool feedback port 24, and a pilot pressure port 26. The PCV 10 further comprises dual independent spools, namely return spool 40 and pressure spool 50, commonly disposed within and situated about a longitudinal axis of the valve body 12. Return and pressure spools 40 and 50 are freely disposed and supported within valve body 12 and restricted in movement by one or more limiting means, such as spool stops 34, 44, 54 and 58.

As shown, this particular embodiment of the valve body 12 comprises a cylindrical, tube shape structure having an interior cavity 60 defined therein by the wall segment of the valve body 12. The interior cavity 60 is configured to contain or house each of the pressure and return spools 40 and 50, as well as to accommodate their displacement. Indeed, the interior cavity 60 comprises a diameter or cross-sectional area that is slightly larger than the diameter or cross-sectional area of the return and pressure spools 40 and 50, thus allowing the return and pressure spools 40 and 50 to move bi-directionally therein, as well as to adequately seal against the inside surface of the wall segment of the valve body 12 as needed. The size of the interior cavity 60 with respect to the return and pressure spools 40 and 50 is such that the return and pressure spools 40 and 50 are able to maintain their orientation within the interior cavity 60 as they are caused to displace back and forth therein.

The interior cavity 60, and the return and pressure spools 40 and 50, may also be configured to achieve a sealed relationship. In essence, the valve body 12, and particularly the interior cavity 60, has defined therein various chambers. As shown in FIG. 1, valve body 12 comprises a pilot pressure chamber 28 defined by the distance or area between the return and pressure spools 40 and 50, a return spool feedback chamber 62 defined by the area between the return spool 40 and an end of the valve body 12, and a pressure spool feedback chamber 68 defined by the area between the pressure spool 50 and an opposing end of the valve body 12. Each one of these chambers varies in size depending upon the realized displacement of one or both of the return and pressure spools 40 and 50 during actuation of the PCV. Each of chambers 62 and 68 are sealed from pilot pressure chamber 28 by the interaction of return and pressure spools 40 and 50 with the inside surface of the wall of the valve body 12.

Providing a sealed relationship between the return and pressure spools 40 and 50 with the valve body 12 functions to maintain the integrity of the system by eliminating unwanted fluid crosstalk and pressure leaks. The return and pressure spools 40 and 50 may comprise a sealed relationship to the valve body 12 using any known means in the art. In the embodiment of FIG. 1, acceptable sealing with very low internal leakage is achieved by using very tight manufacturing tolerances. This approach results in very low friction between spools 40 and 50 and the interior walls of valve body 12. Whatever type of sealing arrangement used, however, the return and pressure spools 40 and 50 are to be configured to displace in response to the pressure differentials acting within the system in an attempt to equalize the pilot pressure and the feedback pressure.

Both the return and pressure spools 40 and 50 comprise a geometric configuration or shape that matches or substantially matches or conforms to the geometric configuration or shape of the interior cavity 60 of the valve body 12. As shown, return and pressure spools 40 and 50 are generally cylindrical in shape, and comprise two lands and a recess therebetween, as well as first and second sides. Specifically, in the embodiment shown in FIG. 1, return spool 40 comprises a pilot pressure side 42, a feedback pressure side 46, a first land 72, a second land 74, and a recess 82 extending between lands 72 and 74. Pressure spool 50 comprises a similar geometric configuration or design in that it also comprises a pilot pressure side 52, a feedback pressure side 56, a first land 76, a second land 78, and a recess 84 extending between lands 76 and 78.

As noted above, feedback side 46 of return spool 40 is in fluid communication with return spool feedback chamber 62, while pilot pressure side 42 is in fluid communication with the pilot pressure chamber 28. Lands 72 and 74 comprise a suitable diameter or cross-sectional area so as to be able to seal against the interior wall surface of the valve body 12. As sealed, and during displacement of the return spool 40, lands 72 and 74 minimize fluid communication or fluid crosstalk between feedback chamber 62, recess 82, and pilot pressure chamber 28. In addition, lands 72 and 74 function with recess 82, since it is smaller in diameter than lands 72 and 74, to facilitate the proper flow of fluid through return inlet port 14 to outlet port 16. Once these ports are opened, the fluid flows into the PCV 10 through the return inlet port 14, through the recess 82 of the return spool 40, and out the return outlet port 16.

Also as noted above, feedback side 56 of pressure spool 50 is in fluid communication with pressure spool feedback chamber 68, while pilot pressure side 52 of pressure spool 50 is in fluid communication with the pilot pressure chamber 28. Lands 76 and 78 also comprise a suitable diameter or cross-sectional area so as to be able to seal against the interior wall surface of the valve body 12. As sealed, and during displacement of the pressure spool 40, lands 76 and 78 minimize fluid communication or fluid crosstalk between feedback chamber 68, recess 84, and pilot pressure chamber 28. In addition, lands 76 and 78 function with recess 84, since it is smaller in diameter than lands 76 and 78, to facilitate the proper flow of fluid through pressure inlet port 18 to pressure outlet port 20. Once these ports are opened, fluid flows into the PCV 10 through the pressure inlet port 18, through the recess 84 of the pressure spool 50, and out the pressure outlet port 20.

The PCV 10, and particularly the valve body 12, further comprises several ports that function to facilitate fluid flow through the PCV 10 and that communicate with the interior cavity 60. In the embodiment shown, the valve body 12 has formed therein several inlet and outlet ports that are regulated by the positioning of the return and pressure spools 40 and 50. Specifically, the valve body 12 comprises a return inlet port 14 and a return outlet port 16, wherein the return spool 40 is caused to displace to open these ports to allow fluid to flow therethrough and pressure to be purged from the PCV 10, and the system in which it is operating, in those conditions when the feedback pressure exceeds the pilot pressure. The valve body 12 also comprises a pressure inlet port 18 in fluid communication with a source of pressurized fluid (not shown), and a pressure outlet port 20, wherein the pressure spool 50 is caused to displace to open these ports to allow pressurized fluid to flow therethrough and pressure to be input into the PCV 10, and the system in which it is operating, in those conditions when the pilot pressure exceeds the feedback pressure.

The relative position of the return and pressure inlet and outlet ports 14, 16, 18, and 20 along the valve body 12 and with respect to the return and pressure spools 40 and 50 are configured so that when the return inlet and outlet ports 14 and 16 are open, or partially open, the pressure inlet and outlet ports 18 and 20 are closed, or partially closed, and vice versa. Thus, the PCV 10, and more particularly the return and pressure spools 40 and 50 and the return and pressure inlet and outlet ports 14, 16, 18, and 20, are configured so that these conditions are met, thus allowing the PCV to function as intended depending upon the pressures acting within the system. One skilled in the art will recognize other design alternatives, other than the specific ones illustrated and described herein, for satisfying these conditions.

In the embodiment shown in FIG. 1, the return inlet and outlet ports 14 and 16 are shown closed by the return spool 40 as positioned within the valve body 12. Pressure inlet and outlet ports 18 and 20 are also shown closed by the pressure spool 50 as positioned within the valve body 12. This condition or operating configuration represents equivalent feedback and pilot pressures, wherein the system is balanced and in a state of equilibrium. In other words, the PCV 10 is static as no pressure differential exists within the system to displace either of the return or pressure spools 40 and 50. Indeed, pressure is neither being input into the system through pressure ports 18 and 20, nor being purged from the system through the return ports 14 and 16 as the system is balanced between the equivalent pilot and feedback pressures. Thus, any loads operable with an actuator controlled by the PCV will also be static.

The return inlet port 14 fluidly communicates with recess 82 in return spool 40 and a load actuator, such as a hydraulic actuator (not shown). Acting within the load actuator is a load pressure that is induced or applied by a load, minus the friction or other losses internal to the actuator mechanism itself. The load pressure directly influences and dictates the feedback pressure, and in some cases can equal the feedback pressure. In contrast, the return outlet port 16 fluidly communicates with the recess 82 in return spool 40 and a primary return reservoir (also not shown). The fluid communication between these various return ports is controlled by return spool 40, as is discussed in greater detail below. It will be appreciated, however, that when the feedback pressure exceeds the pilot pressure, the return spool 40 is caused to displace to open the return inlet and outlet ports 14 and 16, thus allowing fluid to flow through the return inlet port 14, into recess 82 in return spool 40, and subsequently through the return outlet port 16 toward the primary return reservoir to purge pressure from the system. Once a state of equilibrium is reached, the return spool 40 will displace to close the return ports 14 and 16.

One of the unique aspects of the dual independent spool pressure control valve is that the pilot pressure in the system may be dropped and maintained at a level sufficient to open the return spool 40 and the return inlet and outlet ports 14 and 16, as well as to close the return spool 50 over the pressure inlet and outlet ports. In this mode, the PCV 10 enters an inactive passivity operating state, and functions to allow fluid to slosh or shunt back and forth between the load actuator (hydraulic actuator) and the return reservoir through the return inlet and outlet ports 14 and 16, such as in response to external forces acting on and affecting the movement of the load. This effectively allows the load to free swing or dangle without requiring any active input to drive the load in either direction. The concept of dangle with the PCV 10 in the slosh mode is discussed in greater detail below.

The pressure inlet port 18 fluidly communicates with the recess 84 in pressure spool 50 and the pressurized fluid source (not shown). In contrast, the pressure outlet port 20 fluidly communicates with recess 84 in pressure spool 50 and the load actuator. The fluid communication between these various ports is controlled by the pressure spool 50, as is discussed in greater detail below. It will be appreciated, however, that when the pilot pressure exceeds the feedback pressure, the pressure spool 50 displaces to open the pressure inlet and outlet ports 18 and 20, thus allowing pressurized fluid to flow through the pressure inlet port 18, into recess 84 in pressure spool 50, and subsequently through the pressure outlet port 20 to supply pressure to the load actuator, which converts the increased pressure to a force that actively drives the load.

The valve body 12 further has formed therein a pilot pressure port 26 configured to receive pressurized fluid having a corresponding pilot or control pressure and direct it into the pilot pressure chamber 28. The pilot pressure port 26 fluidly communicates with a pilot valve (not shown) configured to supply pressurized fluid from a fluid source, such as a pump, to the pilot pressure chamber 28. The pressurized fluid (at pilot pressure) input into the pilot pressure chamber 28 through the pilot pressure port 26 functions to act upon a pilot pressure side 42 of return spool 40 and a pilot pressure side 52 of pressure spool 50 to influence the displacement of the return and pressure spools 40 and 50 away from each other. In addition, the pilot pressure input into the pilot pressure chamber 28 functions to oppose or counteract the feedback pressure that is also acting on the return and pressure spools 40 and 50 through the fluid feedback system. As such, the pilot pressure functions as a control pressure for the PCV 10 and the system. Indeed, the pilot pressure may be selectively increased or decreased or held constant relative to the feedback pressure to control the displacement of the return and pressure spools 40 and 50, and therefore the pressure within the system. Varying or changing the pilot pressure may be done very rapidly, which allows the PCV to act like a dynamically pre-defined fixed pressure regulator.

It will be appreciated that the size of the pilot pressure chamber 28 can vary with the magnitude of the pilot pressure and the resultant displacement position of the return and pressure spools 40 and 50 within the valve body as opposed by the feedback pressure acting through the feedback system. Thus, the varying size of the pilot pressure chamber 28 is a function of the relationship between the pilot pressure and the feedback pressure. It will also be appreciated that a pilot pressure chamber 28 will always exist in the PCV 10 as the return and pressure spools 40 and 50 are prohibited from making contact with each other no matter the magnitude of the feedback pressure. Indeed, the return and pressure spools 40 and 50 are limited in the distance they are allowed to displace as a result of the limits imposed by the ends of the valve body 12, as well as various means or limiting means strategically placed within the interior cavity 60 of the valve body.

The limiting means are intended to control the displacement distance each of the return and pressure spools 40 and 50 are allowed to travel within the valve body 12. More specifically, the limiting means function to establish a pre-determined operating position for each of the spools during the various operating states or modes of the PCV 10. One exemplary form of limiting means is a plurality of spool stops strategically positioned within the interior cavity 60 of the valve body 12 to prevent unwanted displacement of the spools within the valve body 12. FIG. 1 illustrates these as spool stops 34, 44, 54 and 58. Return and pressure spools 40 and 50 are unable to come into contact with one another due to spools stops 34 and 54, wherein spool stop 34 restricts the movement of the return spool 40 so that it can never close the pilot port 26, and spool stop 54 restricts the movement of the pressure spool 50 from doing the same. Thus, the pilot pressure chamber 28 is always present and accessible to receive fluid from the pilot pressure source through the pilot pressure port 26.

Return spool feedback port 22, formed in a first end of the valve body 12, facilitates the fluid communication of the load actuator (not shown), which may comprise a load actuator such as a hydraulic actuator, with the return spool feedback chamber 62 and the feedback pressure side 46 of return spool 40 functioning as one boundary for the feedback chamber 62. Thus, fluid from the load actuator can flow through the return spool feedback port 22 and into the feedback chamber 62, thereby communicating a feedback pressure to the feedback pressure side 46 of the return spool 40. The feedback chamber 62 comprises a pre-determined diameter or cross-sectional area, which converts the feedback pressure into a feedback force to be exerted on the return spool 40.

It will be appreciated that when the feedback pressure in the return spool feedback chamber 62 is greater than the pilot pressure in the pilot pressure chamber 28, the return spool 40 will displace towards the center of the pilot pressure chamber 28 until it contacts the spool stop 34, thus opening the return inlet and outlet ports 14 and 16 to release and lower the actuator pressure. The return spool 40 stays in this position until the feedback pressure and the pilot pressure equalize. Conversely, when the feedback pressure in the feedback chamber 62 is less than the pilot pressure in the pilot pressure chamber 28, the return spool 40 will displace towards the end of the valve body 12 away from the pilot pressure chamber 28 until it contacts the spool stop 44. In this position, the return inlet and outlet ports 14 and 16 are closed allowing the system pressure to increase. The return spool 40 maintains this position until the pressure in the feedback chamber 62 again exceeds the pilot pressure in the pilot pressure chamber 28.

Similarly, pressure spool feedback port 24, formed in a second end of the valve body 12, facilitates the fluid communication of the load actuator (not shown) with the pressure spool feedback chamber 68 and the feedback pressure side 56 of the pressure spool 50 functioning as one boundary for the feedback chamber 68. Thus, fluid from the load actuator can flow through the pressure spool feedback port 24 and into the feedback chamber 68, thereby communicating a feedback pressure to the feedback pressure side 56 of the pressure spool 50. The feedback chamber 68 comprises a pre-determined diameter or cross-sectional area, which converts the pressure into a feedback force to be exerted on the pressure spool 50.

It will be appreciated that when the feedback pressure in the pressure spool feedback chamber 68 is greater than the pilot pressure in the pilot pressure chamber 28, the pressure spool 50 will displace towards the center of the pilot pressure chamber 28 until it contacts the spool stop 54, thus closing the pressure inlet and outlet ports 18 and 20. The pressure spool 50 maintains this position until the feedback pressure and the pilot pressure equalize. Conversely, when the feedback pressure in the feedback chamber 68 is less than the pilot pressure in the pilot pressure chamber 28, the pressure spool 50 will displace towards the end of the valve body 12 away from the pilot pressure chamber 28, thus opening the pressure inlet and outlet ports 18 and 20 to increase the system pressure. The pressure spool 50 maintains this position until the pressure in the feedback chamber 68 again exceeds the pilot pressure in the pilot pressure chamber 28, at which time the pressure inlet and outlet ports 18 and 20 are closed.

As discussed, limiting means, namely, spool stops 34, 44, 54 and 58, respectively, are configured to limit the movement of return and pressure spools 40 and 50 within the interior cavity 60 of the valve body 12. More specifically, the limiting means are configured to ensure the proper displacement and alignment of the return and pressure spools 40 and 50 with respect to the return and pressure inlet and outlet ports 14, 16, 18, and 20, as well as the pilot pressure port 26. As noted above, spool stops 34 and 54 restrict the movement of return and pressure spools 40 and 50 towards each other. Specifically, spool stop 34 is positioned such that return spool 40 cannot close pilot pressure port 26. Spool stop 34 also prevents fluid communication between the return inlet and outlet ports 14 and 16 and the return spool feedback port 22.

Spool stop 44 restricts the displacement of the return spool 40 towards the end of the valve body 12, as shown. Specifically, spool stop 44 is positioned such that the return inlet and outlet ports 14 and 16 are closed when the return spool 40 contacts the spool stop 44. It will also be appreciated that the position of spool stop 44 also prevents fluid communication between the return inlet and outlet ports 14 and 16 and the pilot pressure chamber 28.

Spool stop 54 restricts the movement of the pressure spool 50 towards the return spool 40 and the pilot chamber 28. Specifically, spool stop 54 is positioned such that the pressure inlet and outlet ports 18 and 20 are closed when the pressure spool 50 contacts the spool stop 54. Spool stop 54 prevents fluid communication of the pressure inlet and outlet ports 18 and 20 with the pressure spool feedback port 24.

Spool stop 58 restricts the displacement of the pressure spool 50 towards the end of the valve body 12, as shown. Specifically, spool stop 58 is positioned such that the pressure inlet and outlet ports 18 and 20 are closed when the pressure spool 50 contacts the spool stop 58. It will also be appreciated that the position of spool stop 58 also prevents fluid communication between the pressure inlet and outlet ports 18 and 20 and the pilot pressure chamber 28.

As stated, the PCV 10 comprises dual, independent spools, namely return spool 40 and pressure spool 50, that are preferably freely situated or supported within the interior cavity 60 of the valve body 12. By freely supported it is meant that the spools are not physically coupled to each other or any other structure or device, such as mechanical actuating or supporting means. In other words, the spools float within the interior of the valve body and are constrained in their movement or displacement only by the pressures acting upon them and any limiting means located in the valve body 12. In one aspect, the return and pressure spools 40 and 50 are low mass spools. However, the mass of the spools may vary depending upon the application.

Return and pressure spools 40 and 50 are intended to operate within the valve body 12 independent of one another. The term "independent" or the phrase "independently controlled and operated," as used herein, is intended to mean that the two spools are operated or controlled individually or separately and that they are free from interconnection with or interdependence upon one another. This also means that the return and pressure spools 40 and 50 displace or are caused to displace in response to the intrinsic pressure parameters acting within the system at any given time and not by any mechanically or electrically controlled actuation device or system. More specifically, the PCV is intended to regulate pressure within the system in which it is contained in accordance with the pressure feedback system intrinsic to the PCV, wherein the return and pressure spools are caused to displace in accordance with a pressure differential occurring or acting within the system in an attempt to dissipate the pressure differential and to equalize the pilot pressure and the feedback pressure. In the embodiment of FIG. 1, a pressure differential exists when the feedback pressure acting on the outside faces of the return and pressure spools differs from the pilot pressure concurrently acting on the inside faces of the return and pressure spools. As these two pressures concurrently acting on opposite sides of the return and pressure spools differ, and depending upon the dominant pressure, the return and pressure spools will displace to open and close the appropriate ports that would facilitate or cut off the fluid flow needed to balance the overall system pressure or that would attempt to balance the load pressure in the load actuator and the pilot pressure.

In the PCV 10, a pressure differential is created when the feedback pressure acting on the feedback pressure sides of the return and pressure spools 40 and 50 comprises a different magnitude than the pressure acting on the pilot pressure sides of the return and pressure spools 40 and 50. This pressure differential may be in favor of the feedback pressure or the pilot pressure. Either way, the return and pressure spools 40 and 50 are designed to displace in response to the pressure differential in an attempt to restore the pilot pressure and the feedback pressure to a state of equilibrium. However, the pilot pressure, since it is specifically and selectively controlled, will be capable of inducing a pre-determined pressure differential for a pre-determined duration of time. Thus, if the pressure in the system needs to be increased, the pilot pressure is selectively manipulated to exceed the feedback pressure, thus causing the pressure spool 50 to displace to open pressure inlet and outlet ports 18 and 20 and to let pressurized fluid from the pressure source into the system. Likewise, if the pressure in the system needs to be reduced, the pilot pressure can be selectively manipulated to be less than the feedback pressure, thus causing the return spool 40 to displace to open return inlet and outlet ports 14 and 16 and to purge pressure from the system. Although obvious, it is noted that a pressure differential may be induced in the system by manipulation of the pilot pressure or the load or both of these. Either way, the resulting displacement of spools functions to open and close the appropriate inlet and outlet ports to regulate the pressure within the system.

In accordance with the immediate discussion, one of the unique features of the dual independent spool pressure control valve is its intrinsic feedback system. Unlike prior related systems that focus on and function to control fluid flow, this intrinsic feedback system functions to allow the PCV to regulate and control the pressures within a servo or servo-type system automatically, in response to induced conditions, or in a manipulative manner, all without requiring external control means. The intrinsic feedback system is a function of the fluid communication between the various components of the PCV and the pilot and feedback pressures. More particularly, the intrinsic feedback system is a function of the communication between the pilot and feedback pressures acting on opposing sides of the independent return and pressure spools, wherein the feedback and pilot pressures oppose one another, and wherein the feedback pressure is a function of the load pressure. The independent return and pressure spools, which may be considered floating spools within the valve body, are configured to act in concert with one another to systematically displace, in accordance with an induced pressure differential, to open the appropriate ports to either increase or decrease overall system pressure. Owing to the various limiting means strategically placed within the system, as well as the relative positioning of the return and pressure inlet and outlet ports, the independent return and pressure spools are configured to displace accordingly to restore the servo system to as close a state of equilibrium as possible, limited only by system constraints and/or selective and controlled operating conditions. Various examples of the dual independent spool pressure control valve intrinsic feedback system are illustrated in the figures and described below with respect to the various operating states of the PCV.

Return and pressure spools 40 and 50 will move to specific positions in response to the pilot pressure, which is controlled according to whether it is desired that a pressure within the load actuator be increased, whether the load actuator is to be allowed to relax, or whether the load actuator will be required to hold a sustained load.

Finally, first and second feedback ports 22 and 24 are in fluid communication with first and second feedback lines 192 and 196, respectively, wherein the first and second feedback lines 192 and 196 are configured to receive fluid from or transmit fluid to main line 200. Main fluid line 200 fluidly connects to the load actuator (not shown) through a load feed line 210.

Thus, it will be appreciated that when the PCV 10 is in a state of equilibrium with the pilot pressure equivalent to the feedback pressure, both the return spool 40 and the pressure spool 50 are positioned to close the return and pressure inlet and outlet ports 14, 16, 18, and 20 along the valve body 12. In situations where the pilot pressure exceeds the feedback pressure, the pressure spool is caused to displace to open pressure inlet port 18 and pressure outlet port 20, allowing fluid to flow from the pressure source, through pressure spool recess 84 and to the load feed line 210. And when the pilot pressure drops below the feedback pressure, the return spool is caused to displace to open return inlet port 14 and return outlet port 16, allowing fluid to flow from the load feed line 210, through return spool recess 82 and to the primary return reservoir.

Further details and operating states of the PCV illustrated in FIG. 1 are shown and described in U.S. Pat. No. 7,284,471 to Jacobsen et al.; and U.S. Pat. No. 7,308,848 to Jacobsen et al., as well as related U.S. patent application Ser. No. 11/824,540, filed Jun. 29, 2007, and entitled, "Pressure Control Valve Having An Asymmetric Valving Structure," each of which are incorporated by reference herein in their entirety herein.

While FIG. 1 illustrates one exemplary embodiment of a PCV, it will be appreciated that other embodiments are contemplated herein. Indeed, the PCV shown in FIG. 1 may be modified to comprise return and pressure spools 40 and 50 of different configurations or sizes. Naturally, however, the valve body 12 would have to comprise corresponding diameters differences to accommodate the different sized spools. Therefore, in other embodiments, it is contemplated that the valve body 12, and the independent spools disposed therein, may comprise uniform or non-uniform diameters, as well as different geometric cross-sectional shapes other than circular. Additionally, ports 14, 16, 18, 20, 22, 24 and 26 in valve body 12 can vary in size, and various size and shape combinations are anticipated in order to obtain particular pressure-force-area relationships necessary for a specific or given application.

Figure 2:
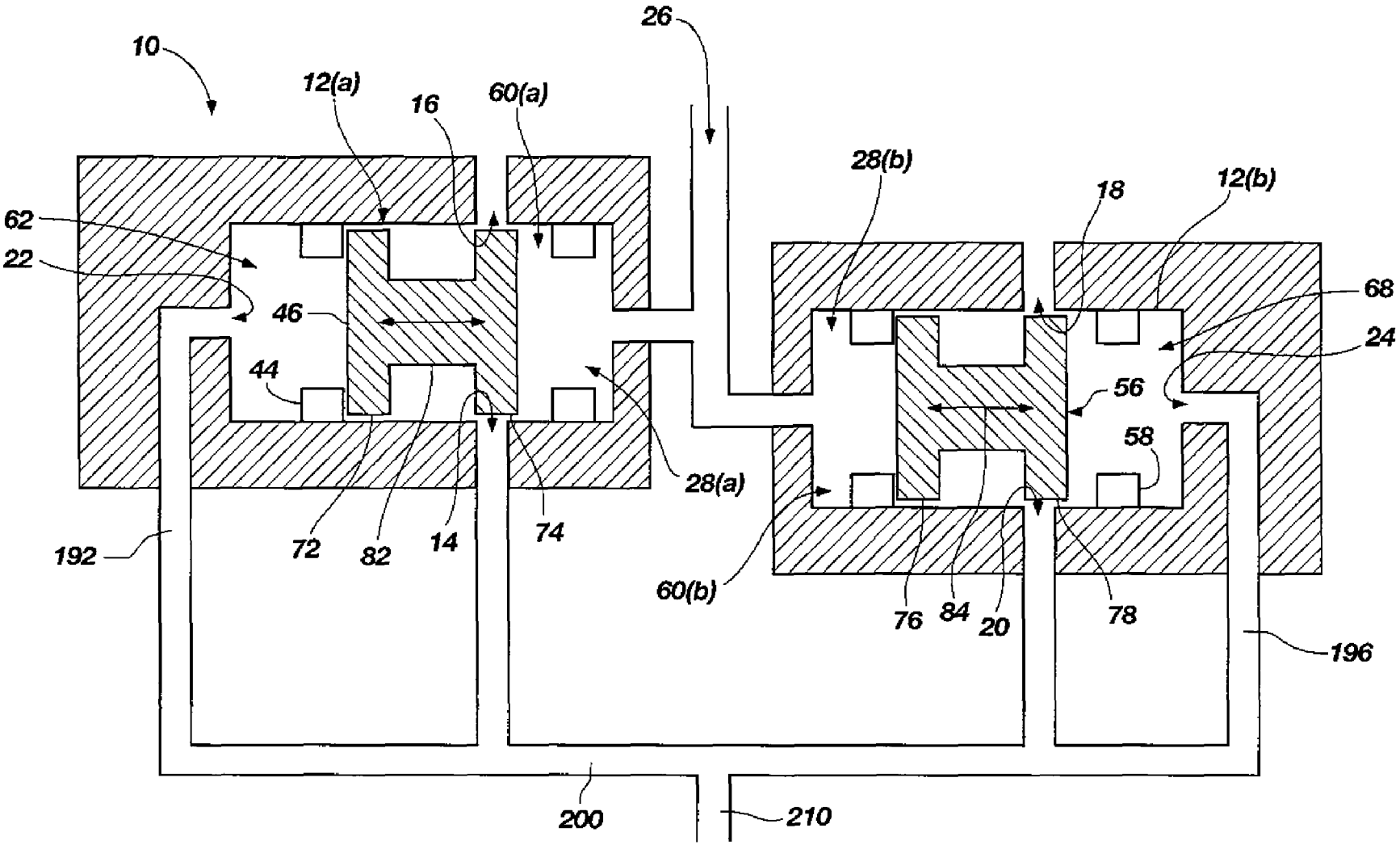
FIG. 2 illustrates a cut-away view, as taken along a longitudinal cross-section, of a dual independent spool pressure control valve according to another exemplary embodiment.

FIG. 2. illustrates another exemplary embodiment of the dual independent spool pressure control valve, wherein the PCV 10 comprises a return valve body 12-*a* separate from a pressure valve body 12*b*. Return valve body 12-*a* comprises an interior cavity 60-*a*, which is further divided into a return spool pilot pressure chamber 28-*a* and a return spool feedback chamber 62 by the return spool 40 of FIG. 1. Likewise, pressure valve body 12-*b* comprises an interior cavity 60-*b*, which is further divided into a pressure spool pilot pressure chamber 28-*b* and a pilot spool feedback chamber 68 by the pressure spool 50 of FIG. 1. Both the return spool pilot pressure chamber 28-*a* and the pressure spool pilot pressure chamber 28-*b* are in fluid communication with pilot pressure port 26. Other than the difference in configuration, wherein the chambers of the return valve and the pressure valve are no longer coaxially connected or aligned, the embodiment of FIG. 2 functions in substantially the same manner as that shown in of FIG. 1, which description is incorporated here, where applicable.

Antagonistic Fluid Control Systems

The present invention fluid control system further comprises various embodiments of an antagonistic fluid control system that utilizes one or more forms of the pressure control valves discussed above to control and facilitate the movement or displacement of a load, typically via one or more actuators, wherein the PCVs operating together comprise several operating or valving states.

A first valving or operating state of the PCVs comprises an active valving state configured to actively control the movement of the load, or in other words drive the load. A second valving or operating state comprises an inactive actuation state, wherein either the return and pressure ports of one PCV are closed, or only the return ports of one PCV are opened, to allow the other PCV to operate in an active valving state. A third valving or operating state comprises a truly passive valving state, namely an inactive passivity valving state, wherein the PCVs are operated in a slosh mode, as discussed above, configured to allow the load to move or dangle. In this third passive valving state, or slosh mode, the return ports of the two PCVs are opened to allow fluid, and preferably local fluid, to shunt back and forth within the system in response to a non-actuated load movement. Thus, in the state of inactive passivity, the load is allowed to move or displace without requiring any active input from the system, such as the use of fluid from the high-pressure supply reservoir. This unique feature has several advantages over prior related servo systems, such as an increase in overall efficiency, and the ability to provide movements that are more natural or that more closely resemble those found in nature, such as the natural movement of a leg or arm.

In one aspect, an antagonistic fluid control system may be realized by way of antagonistic pressure control valves providing actuation to a single actuator. In another aspect, an antagonistic fluid control system may be realized by way of multiple pressure control valves (PCVs) operable, respectively, with the one or more pairs of antagonistic load actuators.

Figure 3:
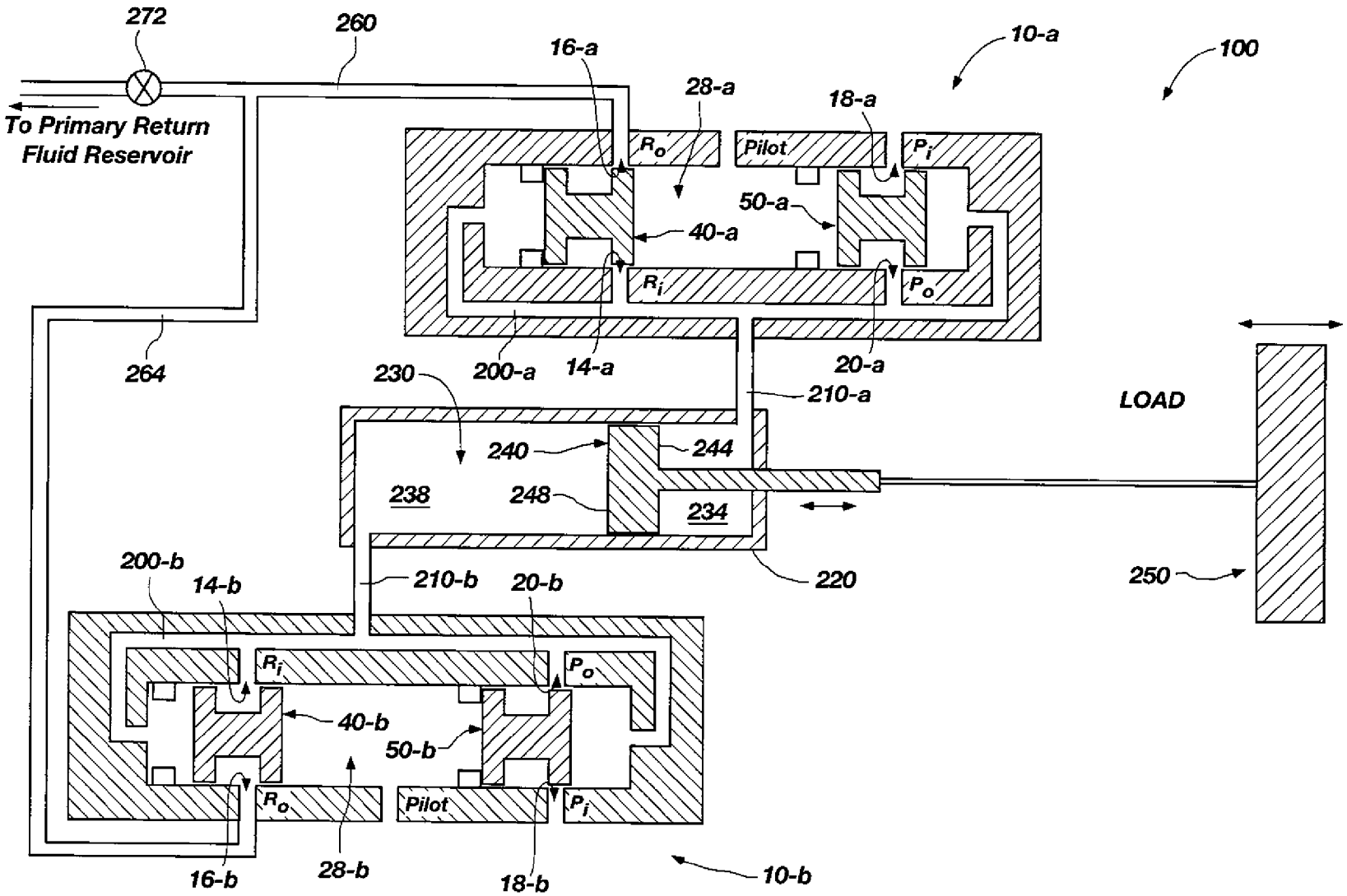
FIG. 3 illustrates a fluid control system, wherein two like antagonistic dual independent spool pressure control valves, such as the pressure control valve of FIG. 1, are used in combination with one another to actuate a single dual-acting actuator, and wherein each of the pressure control valves comprise an intrinsic fluid feedback system.

FIG. 3 illustrates one exemplary embodiment of an antagonistic fluid control system 100. In this embodiment, two dual independent spool PCVs are used in combination with one another to control or provide control pressure to a single actuator 220. The PCVs function together to control pressure within the system 100. Specifically, PCV 10-*a* is configured to control the fluid and pressure used to drive or displace the actuator piston 240, and consequently the load, in one direction, while PCV 10-*b* is configured to control the fluid and pressure used drive or displace the actuator piston 240, and consequently the load, in the opposite direction. Each of the PCVs 10-*a* and 10-*b* are similar in structure as those shown in FIG. 1 and described above.

In operation, PCVs 10-*a* and 10-*b* are configured to operate in either an active valving state, an inactive valving state, or an inactive passive valving state (inactive passivity). The dual PCVs are each individually and selectively controlled to enter any one of these operating states at any given or pre-determined time and for any given or pre-determined duration. In the embodiment shown, PCV 10-*a* is configured to actuate or displace the actuator piston 240, and to drive the load 250, in one direction. In an active valving state, the pilot pressure in the pilot chamber 28-*a* of the PCV 10-*a* is manipulated so that the pressure spool 50-*a* displaces to open the pressure inlet and outlet ports 18-*a* and 20-*a*, while the return inlet and outlet ports 14-*a* and 16-*a* are caused to close. The return spool 40-*a* does not displace as the pilot pressure is kept above that of the pressurized fluid downstream of the PCV in the load feed line 210-*a*.

In an open position, the pressure spool 50-*a* functions to allow pressurized fluid (i.e., fluid having a higher pressure than the load pressure acting within the load chamber 234) from a pressure source (not shown) to enter into the system 100. Pressurized fluid enters pressure inlet port 18-*a*, passes through pressure outlet port 20-*a*, into main fluid line 200-*a*, then into load feed line 210-*a*, and finally into the chamber 234 of the actuator cylinder 230. As the pressurized fluid enters into the chamber 234, it acts upon a first side 244 of the actuator piston 240. Since the force exerted by the pressurized fluid entering chamber 234 is greater than the combined forces produced by the pressure existing within opposing chamber 238 and the external forces acting on the load, such friction or gravity, the actuator piston 240 is caused to displace, thus driving or displacing the coupled load 250 accordingly. According to one embodiment where the fluid control system 100 is controlled based on position, once the load is driven to the point desired, the pilot pressure is again manipulated to displace the pressure spool 50-*a* and close the pressure inlet and outlet ports 18-*a* and 20-*a*.

With the PCV 10-*a* in its active valving state to drive the load 250, the PCV 10-*b* may be kept in an inactive valving state, wherein the return inlet and outlet ports 14-*b* and 16-*b* are caused to open to release fluid from the system 100 to the primary return reservoir (not shown).

Likewise, PCV 10-*b* is configured to actuate or displace the actuator piston 240, and to drive the load 250, in a direction opposite that caused by the active valving state of the PCV 10-*a*. In an active valving state, the pilot pressure in the pilot chamber 28-*b* of the PCV 10-*b* is manipulated so that the pressure spool 50-*b* displaces to open the pressure inlet and outlet ports 18-*b* and 20-*b*, while the return inlet and outlet ports 14-*b* and 16-*b* are caused to close. The return spool 40-*b* does not displace as the pilot pressure is kept above that of the pressurized fluid downstream of the PCV in the load feed line 210-*b*.

In an open position, the pressure spool 50-*b* functions to allow pressurized fluid (i.e., fluid having a higher pressure than the load pressure acting within the load chamber 238) from a pressure source (not shown) to enter into the system 100. Pressurized fluid enters pressure inlet port 18-*b*, passes through pressure outlet port 20-*b*, into main fluid line 200-*b*, then into load feed line 210-*b*, and finally into the chamber 238 of the actuator cylinder 230. As the pressurized fluid enters into the chamber 238, it acts upon a second side 248 of the actuator piston 240. Since the pressure of the fluid entering the chamber 238 is greater than the combined forces produced by the pressure existing within opposing chamber 234 and the external forces acting on the load, such friction or gravity, the actuator piston 240 is caused to displace, thus driving or displacing the coupled load 250 accordingly. According to one embodiment where the fluid control system 100 is controlled based on position, once the load is driven to the point desired, the pilot pressure is again manipulated to displace the pressure spool 50-*b* and close the pressure inlet and outlet ports 18-*b* and 20-*b*.

With the PCV 10-*b* in its active valving state to drive the load 250, the PCV 10-*a* is caused to enter an inactive valving state, wherein the return inlet and outlet ports 14-*a* and 16-*a* are caused to open to release fluid from the system 100 to the primary return reservoir (not shown). The function of PCV 10-*b* is similar to that of PCV 10-*a*.

As can be seen, by selectively and alternately actuating the active valving states of both of the PCVs 10-*a* and 10-*b*, the actuator piston 240, and consequently the load 250, can be displaced or driven back and forth in a bi-directional manner as desired, wherein each PCV is configured to provide opposing unidirectional displacement of the actuator piston 240.

Perhaps the most advantageous feature of the present invention valving system and corresponding fluid control system is the ability of the load to free swing or dangle under either an externally applied load, or as a result of intrinsic forces, such as momentum created during the active actuation of the load by one or both PCVs. The ability to free swing or dangle is a result of the unique configuration and design of the PCVs used to provide the pressure control to the fluid control system. Each of the PCVs shown in FIG. 2 are capable of entering an inactive passive state, or a slosh mode as defined above. In order to endow the load with free swing or dangling capabilities, each of the PCVs 10-*a* and 10-*b* are caused to enter the passive actuation state, or slosh mode, simultaneously.

To enter the inactive passive state, the pilot or control pressures in the each of the respective pilot chambers 28-*a* and 28-*b* of the PCVs 10-*a* and 10-*b* are individually manipulated and maintained to be below the load pressure or feedback pressure acting on the return and pressure spools 40-*a*, 40-*b*, 50-*a* and 50-*b* as exerted by the load actuator 220. As this pilot pressure is below the load or feedback pressure acting on the spools 40 and 50, the return spools 40-*a* and 40-*b* are caused to displace to open return inlet and outlet ports 14-*a*, 16-*a*, 14-*b*, and 16-*b*, respectively. Pressure spools 50-*a* and 50-*b* remain closed due to the limiting means located within each of the PCVs 10-*a* and 10-*b*.

Also part of the configuration of the PCVs 10-*a* and 10-*b* is the fluid connection of the return outlet ports 16-*a* and 16-*b*. As shown, return outlet port 16-*a* of the PCV 10-*a* is fluidly connected to the return outlet port 16-*b* of the PCV 10-*b* via the return lines 260 and 264. Return line 260 is fluidly connected to the return outlet port 16-*a* and extends therefrom to fluidly connect to return line 264, as well as the primary return reservoir (not shown). Similarly, return line 264 is fluidly connected to the return outlet port 16-*b* and extends therefrom to fluidly connect to the return line 260, as well as the primary return reservoir. A flow control valve 272 is situated downstream from the intersection of the return fluid lines 260 and 264 and is configured to selectively regulate return fluid flow from the system 100 to the primary return reservoir.

By fluidly connecting the return outlet ports of the two PCVs, and by controlling the pilot pressures to be below the load or feedback pressures, thus displacing the return spools 40-*a* and 40-*b* and opening the return inlet and outlet ports 14-*a*, 16-*a*, 14-*b*, and 16-*b*, the PCVs 10-*a* and 10-*b* are caused to enter the inactive passive valving state, or slosh mode. In this state, fluid is able to shunt back and forth within the system 100, and particularly between the load actuator 220, the PCV 10-*a*, and the PCV 10-*b*, as the actuator piston 240 displaces back and forth in response to a non-actuated force (i.e. the actuator can easily be backdriven). For example, in the slosh mode, if an external force pulls on the load 250 causing it to displace, the actuator piston 240 coupled to the load also displaces within the actuator load cylinder 230. Displacement of the load 250 and the actuator piston 240 within the load cylinder 230 in this direction functions to displace the fluid within the load cylinder chamber 234 in the direction of the displacement of the actuator piston 240. The displaced fluid, which has low compressibility, flows out of the load feed line 210-*a* and into the main fluid line 200-*a*. Once in the main fluid line 200-*a*, the displaced fluid is unable to flow through the pressure outlet port 20-*a* since the pressure spool 50-*a* is in the closed position. Thus, fluid is forced to flow into the PCV 10-*a* through the return inlet port 14-*a*, past the opened return spool 40-*a*, out the PCV 10-*a* through the return outlet port 16-*a*, and into the return fluid line 260.

With the flow control valve 272 closed, thus cutting off access to the primary return reservoir, the fluid is further forced to flow out of the return fluid line 260 into the return fluid line 264. From here, the fluid flows into the PCV 10-*b* through the return outlet port 16-*b*, past the opened return spool 40-*b*, and out of the PCV 10-*b* through the return inlet port 14-*b*. From the return inlet port 14-*b*, the fluid flows into the main fluid line 200-*b*. Since the pressure outlet port 20-*b* is closed due to the closed positioning of the pressure spool 50-*b*, fluid is unable to enter back into the PCV 10-*b* through the pressure outlet port 20-*b*. Instead, the fluid is forced to enter the load feed line 210-*b*, and subsequently the load cylinder chamber 238 on the opposite side of the actuator piston 240.

It is understood that actuation of the load 250 in the opposite direction will cause the fluid in the system 100 to flow in an opposite direction and back through the path just described.

In an alternative to closing the control valve 272, the primary return reservoir can be slightly pressurized. Maintaining the primary return reservoir at a low positive pressure and then dropping the pilot pressure below the primary return reservoir pressure creates the same effect as closing control valve 272; instead of the hydraulic fluid in PCV 10-*a* flowing back into the primary return reservoir, it will flow through the return lines to PCV 10-*b*, and from there into the chamber on the opposite side of the actuator piston 240.

The back and forth displacement of the fluid in the system 100 when the PCVs 10-*a* and 10-*b* are in the inactive passive valving state or slosh mode is described herein as the shunting of the fluid within the system and facilitates the free swing or dangle of the load 250. As can be seen, the load 250, and the actuator piston 240 coupled to the load 250, are able to move under the externally applied load without active input from the system. In other words, no active input is needed to facilitate or enable the displacement of the load and the actuator piston in response to the externally applied force. Instead, the load 250, and the actuator piston 240, are allowed to free swing or dangle in direct response to the force applied to the load 250.

A further advantage of the present invention is the ability to position both PCVs 10-*a* and 10-*b* in the inactive passive valving state as the load is being decelerated, or in other words, move the system into slosh mode for efficient braking. Depending upon the circumstances, ending an active actuation of the load may result in a corresponding momentum force induced within the load. This momentum force (if sufficient to further displace the load) may be efficiently reduced by placing the PCVs in the inactive passive valving state, or slosh mode. In this state, the shunting of the fluid between the PCVs and the load actuator results in loses which dissipate the kinetic energy of the load. When braking in slosh mode the PCVs will allow the load to passively displace a distance beyond that provided by the active displacement of the load, but no additional fluid from the high-pressure supply reservoir will be used to retard or arrest the movement of load.

It is noted herein that the inactive passive valving state of the PCVs utilizes, for the most part, local fluid. The phrase "local fluid" is defined herein as that fluid that is contained within the PCVs, the load actuator, and any fluid lines extending therebetween, and that is not part of the primary return reservoir. More specifically, "local fluid" is intended to mean that fluid existing within the fluid control system that is isolated or fluidly disconnected from the primary return reservoir at the time the PCVs are placed in the inactive passive valving states. In the embodiment shown in FIG. 3, the local fluid comprises that fluid which exists within the PCV 10-*a*, the PCV 10-*b*, and the load actuator 220, as well as the lines connecting these (namely load feed lines 210-*a* and 210-*b*, main fluid lines 200-*a* and 200-*b*, and return lines 260 and 264).

As can be seen, the local fluid in the actuation system 100 of FIG. 1 may be fluidly disconnected from the primary return reservoir by the closing of the flow control valve 272. However, in an alternative to closing control valve 272, the primary return reservoir can be slightly pressurized. Maintaining the primary return reservoir at a low pressure and then dropping the pilot pressure below the return reservoir pressure accomplished the same effect as closing control valve 272. With a pressurized primary return reservoir there may be a slight amount of back flow from the reservoir into return lines 260 and 264 when the system is placed in slosh mode by dropping the pilot pressures of both PCVs below that of the primary return reservoir. However, the amount of fluid flow between the return reservoir and the actuator is very small.

Figure 4:
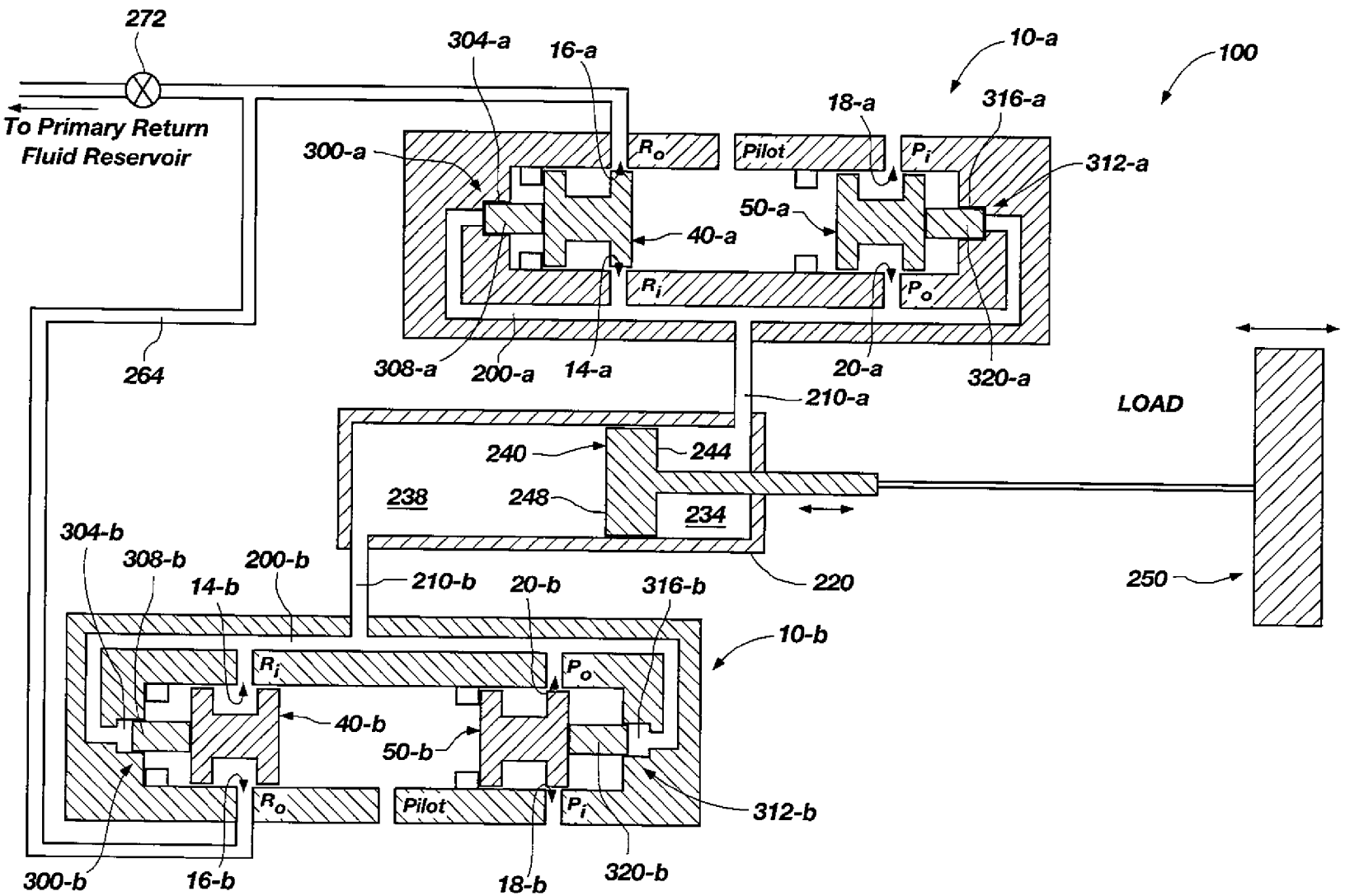
FIG. 4 illustrates a fluid control system, wherein two like antagonistic dual independent spool pressure control valves, such as the pressure control valve of FIG. 1, are used in combination with one another to actuate a single dual-acting actuator, and wherein each of the pressure control valves comprise an intrinsic mechanical feedback system.

Referring now to FIG. 4, illustrated is an alternative embodiment to the embodiment shown in FIG. 3 and discussed above. FIG. 4 illustrates dual PCVs 10-*a* and 10-*b* that are used in combination with a single actuator 220 to control pressure within the fluid control system 100. Specifically, PCV 10-*a* is configured to control the fluid and pressure used to drive or displace the actuator piston 240, and consequently the load 250, in one direction, while PCV 10-*b* is configured to control the fluid and pressure used drive or displace the actuator piston 240, and consequently the load 250, in the opposite direction. Each of the PCVs 10-*a* and 10-*b* are similar in structure as those shown in FIGS. 1-3 and described above, only the PCVs 10-*a* and 10-*b* illustrated in FIG. 4 comprise an intrinsic mechanical feedback system, such as those described in the patent identified above, and incorporated herein.

As shown, PCV 10-*a* comprises a first intrinsic mechanical feedback system 300-*a*, which consists of a feedback cylinder 304-*a* and a feedback piston 308-*a*. PCV 10-*a* also comprises a second intrinsic mechanical feedback system 312-*a*, which also consists of a feedback cylinder 316-*a* and a feedback piston 320-*a*. Likewise, PCV 10-*b* comprises a first intrinsic mechanical feedback system 300-*b*, which consists of a feedback cylinder 304-*b* and a feedback piston 308-*b*. PCV 10-*b* also comprises a second intrinsic mechanical feedback system 312-*b*, which also consists of a feedback cylinder 316-*b* and a feedback piston 320-*b*. The PCVs 10-*a* and 10-*b* illustrated in FIG. 3 function in a similar manner as the PCVs illustrated in FIG. 2, only the PCVs illustrated in FIG. 3 utilize a mechanical feedback system instead of a fluid feedback system. Thus, the above discussion with respect to FIG. 2 is hereby incorporated, where applicable.

Figure 5:
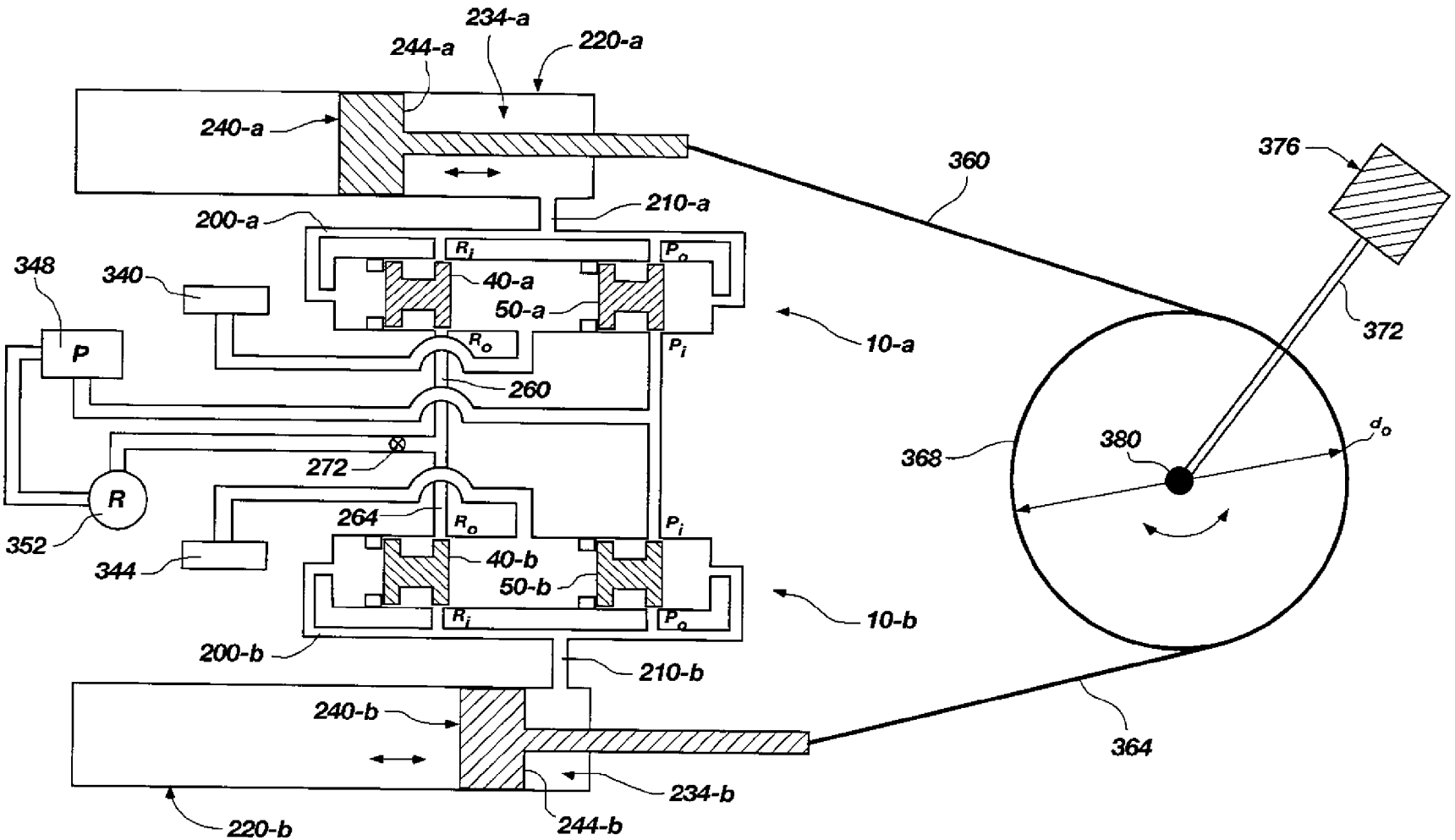
FIG. 5 illustrates a fluid control system in accordance with another exemplary embodiment of the present invention, wherein two antagonistic dual independent spool pressure control valves that function to actuate respective tendon actuators configured to drive a load via opposing tendons supported by a pulley.

FIG. 5 illustrates a fluid control system in accordance with one exemplary embodiment of the present invention, wherein the fluid control system utilizes the pressure control valves discussed above. More specifically, the fluid control system comprises two dual independent spool pressure control valves that function to actuate respective antagonistic tendon actuators configured to drive a load via opposing tendons supported by a pulley. As shown, the fluid control system comprises a first PCV 10-*a* configured in a similar manner as the PCV described above and illustrated in FIG. 1, which description is incorporated herein. The first PCV 10-*a* comprises dual independent spools 40-*a* and 50-*a* that independently displace within the valve body of the PCV in accordance with a pressure differential between a load pressure as exerted by a load 376 through a load actuator 220-*a* and a pilot or control pressure as received from a pilot valve 340.

Likewise, the fluid control system comprises a second PCV 10-*b*, also configured in a manner similar to the PCV described above and illustrated in FIG. 1. The second PCV comprises dual independent spools 40-*b* and 50-*b* that independently displace within the valve body of the PCV in accordance with a pressure differential between a load pressure as exerted by the load 376 through a load actuator 220-*b* and a pilot or control pressure as received from a pilot valve 344.

The first and second PCVs 10-*a* and 10-*b* are fluidly coupled to one another via their return outlet ports and fluid lines 260 and 264, which are also in fluid communication with return reservoir 352. However, as described above, a valve 272 may be included to prevent fluid flow to the return reservoir 352 when the PCVs are operated in slosh mode. Or, as also described above, the return reservoir may be maintained at a low positive pressure. The PCVs are also fluidly coupled to one another via their pressure inlet ports, which are also in fluid communication with pressure source or supply reservoir 348. Of course, as one skilled in the art will recognize, separate supply and return reservoirs may be incorporated, or separate pressure supply lines may be used rather than fluidly coupling PCVs 10-*a* and 10-*b* together via their pressure inlet ports.

The first PCV 10-*a* is configured to operate and control the first load actuator 220-*a*, which comprises a piston 240-*a* disposed within a cylinder. The first load actuator 220-*a*, or more particularly the piston 240-*a*, is tethered to a tendon 360, which is supported by a pulley 368 configured to rotate about a pivot point 380.

The second PCV 10-*b* is configured to operate and control the second load actuator 220-*b*, which also comprises a piston 240-*b* disposed within a cylinder. The second load actuator 220-*b*, or more particularly the piston 240-*b*, is tethered to a second tendon 364, which is also supported by the pulley 368. The tendons 360 and 364 are configured to be in tension between the pistons and the pulley 368. The tendons 360 and 364 may be lengths of a single tendon (e.g., a single cable) wrapped around the pulley 368, or they may be independent tendons (e.g., two separate cables) each coupled to each other and/or the pulley 368 and the respective load actuators. The pulley 368 is further configured to support a load 376, such that upon actuation of the various load actuators, the pulley 368 is caused to rotate to drive the load back and forth.

In operation, namely to drive the load 376 and control its back and forth movements, the various actuators 220-*a* and 220-*b* are actuated. This is done by controlling the pilot pressures within the system as applied to the various load actuators 220-*a* and 220-*b* from the PCVs 10-*a* and 10-*b*, respectively. For example looking at FIG. 5, to drive the load in a counterclockwise direction the pilot valve 340 is caused to increase the pilot or control pressure fed to the pilot chamber of the PCV 10-*a*. Increasing the pilot pressure to be above the load pressure exerted on the piston 240-*a* causes the spool 50-*a* within the PCV 10-*a* to displace to open the pressure port in fluid communication with the pressure source 348. Pressurized hydraulic fluid is then allowed to flow from the PCV 10-*a* into the load actuator 220-*a* through fluid line 210-*a* and into chamber 234-*a*. The increased pressure overcomes the load pressure and causes piston 240-*a* within the cylinder to displace away from the chamber opening. Since the piston 240-*a* is tethered to the tendon 360, the tendon 360 is pulled on as the piston 240-*a* displaces, which rotates the pulley 368 in a counterclockwise direction, thus in turn rotating the load 376 also in a counterclockwise direction, or in other words, driving the load. As the pulley 368 is caused to rotate in a counterclockwise direction, this effectively pulls the tendon 364, which causes the piston 240-*b* within the second load actuator 220-*b* to displace within its cylinder, as the two are tethered together. As such, the fluid within the load actuator 220-*b* is forced out of the chamber through the fluid line 210-*b* and into the second PCV 10-*b* through its return inlet port. Since the fluid in the system is substantially incompressible, this is made possible only by opening the return inlet port in the PCV 10-*b*. Therefore, as the pilot valve 340 is caused to increase the pilot pressure to the first PCV 10-*a*, the pilot valve 344 is simultaneously caused to decrease the pilot pressure to the second PCV 10-*b*. Decreasing the pilot pressure to the second PCV 10-*b* effectively causes the return spool 40-*b* to displace to open the return inlet and outlet ports. Thus, as the pulley 368 is rotated counterclockwise and the piston 240-*b* displaced to compensate, fluid is able to flow from the second load actuator 220-*b*, through the PCV 10-*b*, and back to the return reservoir 352.

To operate the fluid control system to rotate the pulley 368 in the clockwise direction, and therefore to drive the load accordingly, the system is actuated in an inverse manner, namely the pilot pressure in the second PCV 10-*b* is increased while the pilot pressure in the first PCV 10-*a* is decreased.

In slosh mode, the pilot pressures in both the PCVs 10-*a* and 10-*b* are individually lowered and maintained at a sufficiently reduced level to open the return inlet and outlet ports in each PCV 10-*a* and 10-*b*. The return outlet ports of each PCV are in fluid communication with one another. As discussed, in the slosh mode, the load is allowed to freely rotate or dangle in response to external or intrinsic input without active actuation of either load actuator 220-*a* or 220-*b*. The discussion with respect to slosh discussed above is incorporated herein, as applicable. In the slosh mode, the load 376 may rotate back and forth without active actuation as fluid is capable of shunting back and forth between the PCVs 10-*a* and 10-*b*. The fluid shunting back and forth may be caused to be local fluid only by closing the valve 272 in the return line leading to the return reservoir 352.

The fluid control system as configured in FIG. 5 offers additional significant advantages over prior related systems. First, the mechanism provides a larger range of motion compared to that achieved using dual acting linear actuators with mechanical linkages. And second, the actuator can also be operated in a manner that effectively eliminates backlash, as both tendons may be kept under tension (co-contracting) while the load is being moved. Both features, when combined with the capability of placing the control mechanism in slosh mode as described above, provides improved performance in an exemplary operating environment for the exemplary fluid control systems described herein, such as those used to control the movements in an arm or leg of a robot, wherein the arm or leg is capable of providing more natural lifelike movements as a result of the ability to dangle. Exploiting the passive braking capability provided by the pair of PCVs further improves system performance and efficiency.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A fluid control system employing antagonistic pressure control, said fluid control system comprising:

a load actuator having an actuator piston coupled to a load, said load actuator configured to facilitate active and passive displacement of said load;

a first pressure control valve operable with said load actuator and configured to provide a control pressure to a first side of said piston of said load actuator and to facilitate active and passive displacement of said actuator piston and said load; and a second pressure control valve operable with said load actuator and configured to provide a control pressure to a second side of said piston of said load actuator, and to facilitate active and passive displacement of said actuator piston and said load in a direction opposite that facilitated by said first pressure control valve, said first and second pressure control valves comprising an active valving state for selectively driving said actuator piston and said load in respective directions, and a passive valving state, wherein local fluid is caused to shunt back and forth within said fluid control system to allow said actuator piston and said load to passively displace in response to a non-actuated force acting on said load.

2. The fluid control system of claim 1, wherein said first and second pressure control valves each respectively comprise:

a valve body having return and pressure inlet and outlet ports and first and second feedback ports formed therein for fluidly communicating with an interior cavity of said valve body;

a return spool freely supported within said valve body and configured to regulate fluid flow through said return inlet and outlet ports;

a pressure spool, independent of said return spool, and freely supported within said valve body opposite said return spool, said pressure spool configured to regulate fluid flow through said pressure inlet and outlet ports;

an intrinsic pressure feedback system configured to displace said return and pressure spools in response to a pressure differential created between a pilot pressure and a feedback pressure concurrently acting on opposing sides of said return and pressure spools, said intrinsic pressure feedback system configured to dissipate said pressure differential and equalize said pilot pressure and said feedback pressure; and limiting means located within said valve body and configured to establish limiting positions of said return and pressure spools within said valve body during various valving states.

3. The fluid control system of claim 2, wherein said return outlet port of said first pressure control valve is in direct fluid communication with said return outlet port of said second pressure control valve.

4. The fluid control system of claim 2, wherein said return inlet port of said first pressure control valve is in fluid communication with said first side of said piston actuator.

5. The fluid control system of claim 2, wherein said return inlet port of said second pressure control valve is in fluid communication with said second side of said piston actuator.

6. The fluid control system of claim 1, wherein said active valving states of said first and second pressure control valves are alternated to provide bi-directional displacement of said load.

7. The fluid control system of claim 2, wherein said active valving states of said first and second pressure control valves comprise an input of a pre-determined amount of pressurized fluid through said pressure ports at a pre-determined pressure for a pre-determined duration.

8. The fluid control system of claim 1, further comprising means for isolating said local fluid from said primary fluid reservoir.

9. The fluid control system of claim 8, wherein said means for isolating comprises a flow control valve.

10. A fluid control system comprising:

a first load actuator having an actuator piston coupled to a load, said first load actuator configured to facilitate active and passive displacement of said load;

a second load actuator antagonistic to said first load actuator and having an actuator piston also coupled to said load, said second load actuator configured to facilitate active and passive displacement of said load in an opposite direction;

a first pressure control valve operable with said first load actuator to provide a control pressure thereto to effectuate active and passive displacement of said actuator piston of said first load actuator and said load; and a second pressure control valve operable with said second load actuator to provide a control pressure thereto and to effectuate active and passive displacement of said actuator piston of said second load actuator and said load, said first and second pressure control valves comprising an active valving state for selectively driving said actuator pistons of said first and second load actuators in opposite directions, respectively, and a passive valving state, wherein local fluid is caused to shunt back and forth within said fluid control system to allow said actuator pistons of said first and second load actuators to passively displace in response to a non-actuated force acting on said load.

11. The fluid control system of claim 10, wherein said first and second pressure control valves each respectively comprise:

a valve body having return and pressure inlet and outlet ports and first and second feedback ports formed therein for fluidly communicating with an interior cavity of said valve body;

a return spool freely supported within said valve body and configured to regulate fluid flow through said return inlet and outlet ports;

a pressure spool, independent of said return spool, and freely supported within said valve body opposite said return spool, said pressure spool configured to regulate fluid flow through said pressure inlet and outlet ports; and an intrinsic pressure feedback system configured to displace said return and pressure spools in response to a pressure differential created between a pilot pressure and a feedback pressure concurrently acting on opposing sides of said return and pressure spools, said intrinsic pressure feedback system configured to dissipate said pressure differential and equalize said pilot pressure and said feedback pressure; and limiting means located within said valve body and configured to establish limiting positions of said return and pressure spools within said valve body during various valving states.

12. The fluid control system of claim 11, wherein said actuator pistons of said first and second load actuators are coupled to said load via tendons.

13. The fluid control system of claim 12, wherein said load is coupled to and supported, at least in part, by a pulley, which also supports said tendons, said first and second pressure control valves being selectively manipulated to selectively actuate said first and second load actuators to control the active directional rotation and displacement of said pulley, and therefore said load.

14. A method for operating a fluid control system configured to drive a load, said method comprising:

providing a first pressure control valve configured with independent first pressure and return spools, wherein said first pressure and return spools are acted upon by a first load pressure;

providing a second pressure control valve configured with independent second pressure and return spools, wherein said second pressure and return spools are acted upon by a second load pressure;

coupling a load actuator, being configured to actuate a load, to said first pressure control valve and said second pressure control valve, wherein said first and second pressure control valves are antagonistic; and operating said first and second pressure control valves, respectively, to actuate said load in different directions.

15. The method of claim 14, further comprising:

reducing a first pilot pressure and a second pilot pressure to be below said first and second load pressures, respectively, to cause said first and second return spools to displace to open respective return inlet and outlet ports of said first and second pressure control valves, wherein said first pressure and return spools are acted upon by said first pilot pressure and said second pressure and return spools are acted upon by said second pilot pressure and said second load pressure, and wherein said first and second pilot pressures act independently from each other;

causing fluid to shunt back and forth between said first and second pressure control valves and said load actuator via said respective return inlet and outlet ports, thereby initiating a valving state of inactive passivity, wherein an actuator piston of said load actuator is caused to passively displace without active input.

16. The method of claim 14, further comprising coupling an additional load actuator to said second pressure control valve, said additional load actuator being configured to actuate said load in a direction opposite from that actuated by said load actuator.

17. A method for operating a fluid control system configured to drive a load, said method comprising:

providing a first pressure control valve configured with independent first pressure and return spools, wherein said first pressure and return spools are acted upon by a first load pressure;

providing a second pressure control valve configured with independent second pressure and return spools, wherein said second pressure and return spools are acted upon by a second load pressure;

coupling a first load actuator, being configured to actuate a load, to said first pressure control valve;

coupling a second load actuator, being configured to actuate said load, to said second pressure control valve, wherein said second load actuator is antagonistic to said first load actuator; and operating said first and second pressure control valves, respectively, to actuate said load in different directions.

18. The method of claim 17, further comprising:

reducing a first pilot pressure and a second pilot pressure to be below said first and second load pressures, respectively, to cause said first and second return spools to displace to open respective inlet and outlet ports of said first and second pressure control valves, wherein said first pressure and return spools are acted upon by said first pilot pressure and said second pressure and return spools are acted upon by said second pilot pressure and said second load pressure, and wherein said first and second pilot pressures act independently from each other;

causing fluid to shunt back and forth between said first and second pressure control valves and said first and second load actuators via said respective return inlet and outlet ports, thereby initiating a valving state of inactive passivity, wherein an actuator piston of each of said first and said second load actuators is caused to passively displace without active input.

* * * * *